US005271619A

United States Patent [19]

Caminiti

[11] Patent Number: 5,271,619

[45] Date of Patent: Dec. 21, 1993

[54] SHUFFLE BOWL BOWLING AID

[76] Inventor: Anthony D. Caminiti, 6909 N. Brevard Ave., Tampa, Fla. 33604

[21] Appl. No.: 590,800

[22] Filed: Oct. 1, 1990

[51] Int. Cl.[5] ..... A63D 5/00

[52] U.S. Cl. ..... 473/56; 273/129 M; 273/129 S; 473/62

[58] Field of Search ..... 273/67 R, 128 A, 129 R, 273/129 L, 129 M, 54 R, 54 A, 80 D, 81 C, 166

[56] References Cited

U.S. PATENT DOCUMENTS

| | | | |
|---|---|---|---|
| 2,263,602 | 11/1941 | Whittle | 273/129 M |
| 2,435,855 | 2/1948 | Pein | 273/129 M |
| 3,163,422 | 12/1964 | Swardlick | 273/80 D |
| 3,228,693 | 1/1966 | Ingebo | 273/129 M |
| 3,532,344 | 10/1970 | Masstab . | |
| 3,712,652 | 1/1973 | Vilkema | 273/80 D |
| 4,470,598 | 9/1984 | Steele et al. | 273/54 R |

*Primary Examiner*—V. Millin
*Assistant Examiner*—William M. Pierce

[57] ABSTRACT

Apparatus for assisting a physically impaired person when bowling comprising a dolly having roller means therebeneath for effecting a linear direction of motion to the dolly; a pedestal supported on the dolly, the pedestal having a shaft therein mounted in the direction of motion of the dolly, the shaft being mounted to allow rotational motion but to preclude linear motion of the shaft; a faceplate secured to the forward end of the shaft with rollers extending forwardly thereof for contacting a bowling ball to be rolled; a handle coupled to the rearward end of the shaft for imparting a linear motion to the shaft, pedestal, dolly, roller means, faceplate, rollers and bowling ball; a coupling joining the handle and shaft; and vertical plates mounted on the dolly on opposite sides of the coupling to allow for only vertical movement of the handle with respect to the shaft.

1 Claim, 5 Drawing Sheets

SHUFFLE BOWL BOWLING AID

BACKGROUND OF THE INVENTION

1. Summary of the Invention

This invention pertains to mechanical aids to assist bowlers who are physically impaired, or are too weak or too young such as a child who would be unable to lift, hold, carry or swing a conventional bowling ball by means of the usual plurality of finger and thumb holes. It will also enable, in its various forms, wheel-chair bound, walker, cane or crutch assisted abmulatory persons, amputees missing fingers, hands, wrists or even forearms to bowl in a nearly conventional manner, developing the same bowling skills as a physically able bowler.

2. Description of the Background Art

Prior art includes such devices as ramps, wherein the bowler merely shoves the ball down an inclined track towards the pins; there are specially constructed bowling balls with retractable handles which, when released by the bowler, retract back into the ball, conforming to the spherical configuration of the ball. However, even this type of ball is too heavy for some people with arthritis or other hand-disfigured disabilities, or very small children who simply cannot pick up the lightest bowling ball with one hand. It can be used by people with mild or severe back problems as well as those unable to bend their knees as in the usual two, three, four or more steps approaching the foul line on a conventional bowling lane.

This invention is loosely patterned after the shuffle cue used in the game of shuffleboard. However, this bowling aid has a unique guiding device at its terminus to grip, guide, and impart hooks or curves to a bowling ball as in conventional bowling techniques. It can be used from a standing, sitting or walking approach to the foul line, depending upon the user's capabilities. All that is required is that a bowler be able to swing his upper extremity. This invention and its use may become known as shuffle bowling, although its acceptance by the American Bowling Congress is anticipated in regular sanctioned bowling, since their rules only preclude aids which provide additional impetus to a bowling ball beyond that of a conventional swinging approach.

The ease with which this invention can be used, due to its lightness in weight and easily learned technique will prove to be very beneficial and enjoyable to those previously unable to physically bowl or who bowled with aids which virtually eliminated imparted skill to the launching of the bowling ball.

As illustrated by the great number of prior patents as well as commercial devices, efforts are continuously being made in an attempt to improve bowling aids to render them more efficient, effective, comfortable and economical. No prior effort, however, provides the benefits attendant with the present invention. Additionally, the prior efforts do not suggest the present inventive combination of component elements arranged and configured as disclosed and claimed herein.

The present invention achieves its intended purposes, objects, and advantages over the prior art devices through a new, useful and unobvious combination of component elements, with the use of a minimum number of functioning parts, at a reasonable cost to manufacture, and by employing only conventional and readily available materials.

Therefore, it is an object of this invention to provide an improved apparatus for use when bowling comprising a dolly having pedestal means thereabove; roller means therebeneath for effecting a linear direction of motion to the dolly; and shaft means mounted through the pedestal means; rollers coupled to one end of the shaft means for contacting a bowling ball to be rolled; and handle means coupled to the other end of the shaft means for imparting a motion to the rollers through the shaft.

It is another object of this invention to assist handicapped people enjoy the sport of bowling.

It is another object of the invention to propel a bowling ball through the use of specially designed, easy to use apparatus.

Lastly, it is an object of the present invention roll a bowling ball with the assistance of a device which converts a linear and rotational motion of a person's hand into a like motion of the bowling ball.

Accordingly, other objects and a fuller understanding of the invention may be had by referring to the summary of the invention and the detailed description of the preferred embodiments in addition to the scope of the invention defined by the claims taken in conjunction with the accompanying drawings.

SUMMARY OF THE INVENTION

The invention is defined by the appended claims with the specific embodiments shown in the attached drawings. For the purpose of summarizing the invention, the invention may be incorporated into an improved apparatus for assisting a physically impaired person when bowling comprising a dolly having roller means therebeneath for effecting a linear direction of motion to the dolly; a pedestal supported on the dolly, the pedestal having a shaft therein mounted in the direction of motion of the dolly, the shaft being mounted to allow rotational motion but to preclude linear motion of the shaft; a faceplate secured to the forward end of the shaft with rollers extending forwardly thereof for contacting a bowling ball to be rolled; a handle coupled to the rearward end of the shaft for imparting a linear motion to the shaft, pedestal, dolly, roller means, faceplate, rollers and bowling ball; a coupling joining the handle and shaft; and vertical plates mounted on the dolly on opposite sides of the coupling to allow for vertical movement of the handle with respect to the shaft.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It shouldd be appreciated by those skilled in the art that the conception and the disclosed specific embodiment may be readily utilized as a basis for modifying or designing other structures for carrying out the same purposes of the present invention. It should be realized by those skilled in the art that such equivalent constructions do not depart from the spirit and scope of the invention as set forth in the appended claims.

DESCRIPTION OF THE DRAWINGS

For a fuller understanding of the nature and objects of the present invention, reference should be had to the following detailed description taken in conjunction with the accompanying drawings in which:

FIG. 9 is a perspective view of the device shown in FIG. 8 as applied and fastened to a user's wrist.

Similar numerals refer to similar parts throughout the various Figures.

DETAILED DESCRIPTION OF THE INVENTION

Figures 1, 2:
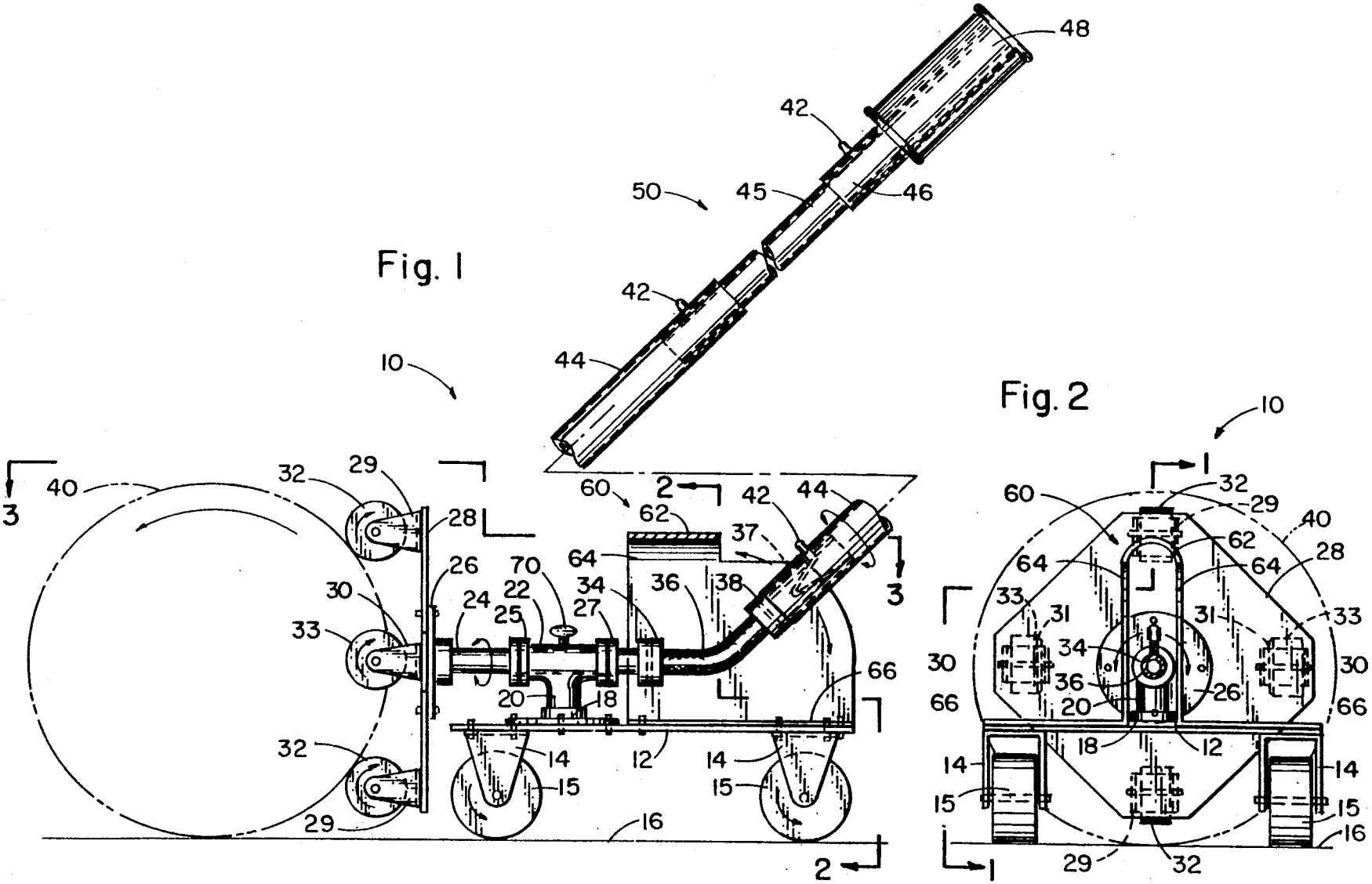
FIG. 1 is a perspective illustration of a device constructed in accordance with the principles of my invention.
FIG. 2 is a side elevational view of the preferred configuration of the invention with a partial section through the aiming guide portion of the device, taken along the lines 1—1 of FIG. 2, and, FIG. 3 is a rear elevational view of the invention with a partial section taken along the lines 3—3 of FIG. 2, and, FIG. 4 is a top plan view of the invention, and, FIG. 5 is a side elevational view of a secondary version of the invention with a partial section taken along the lines 5—5 of FIG. 6, and, FIG. 6 is a rear elevational view of the form shown in FIG. 5 and, FIG. 7 is a top plan view of the form shown in FIGS. 5 and 6, and, FIG. 8 is a perspective view of a handle modified to be fastened to a user's wrist.
Figure 1A:
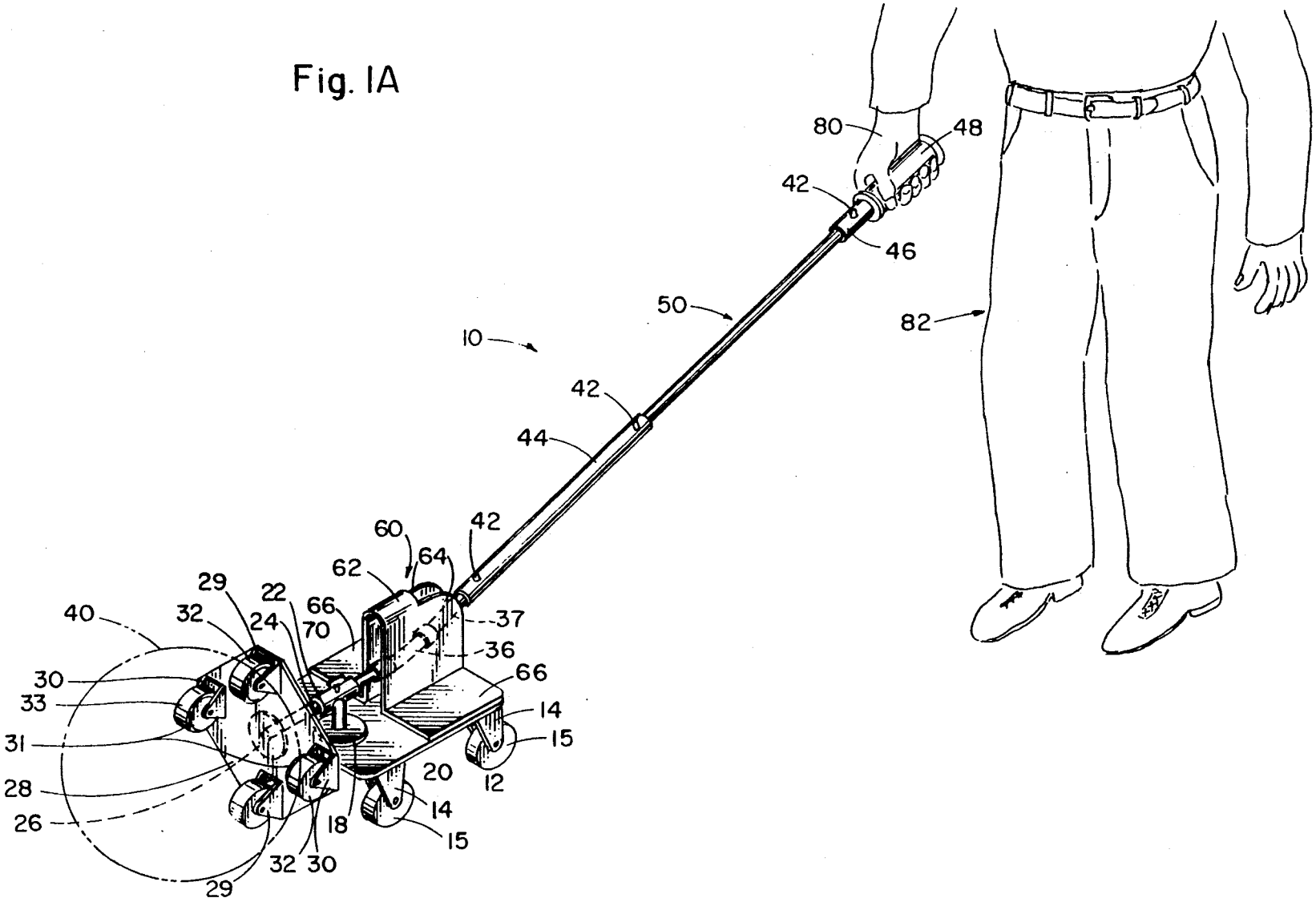
Figure 3:
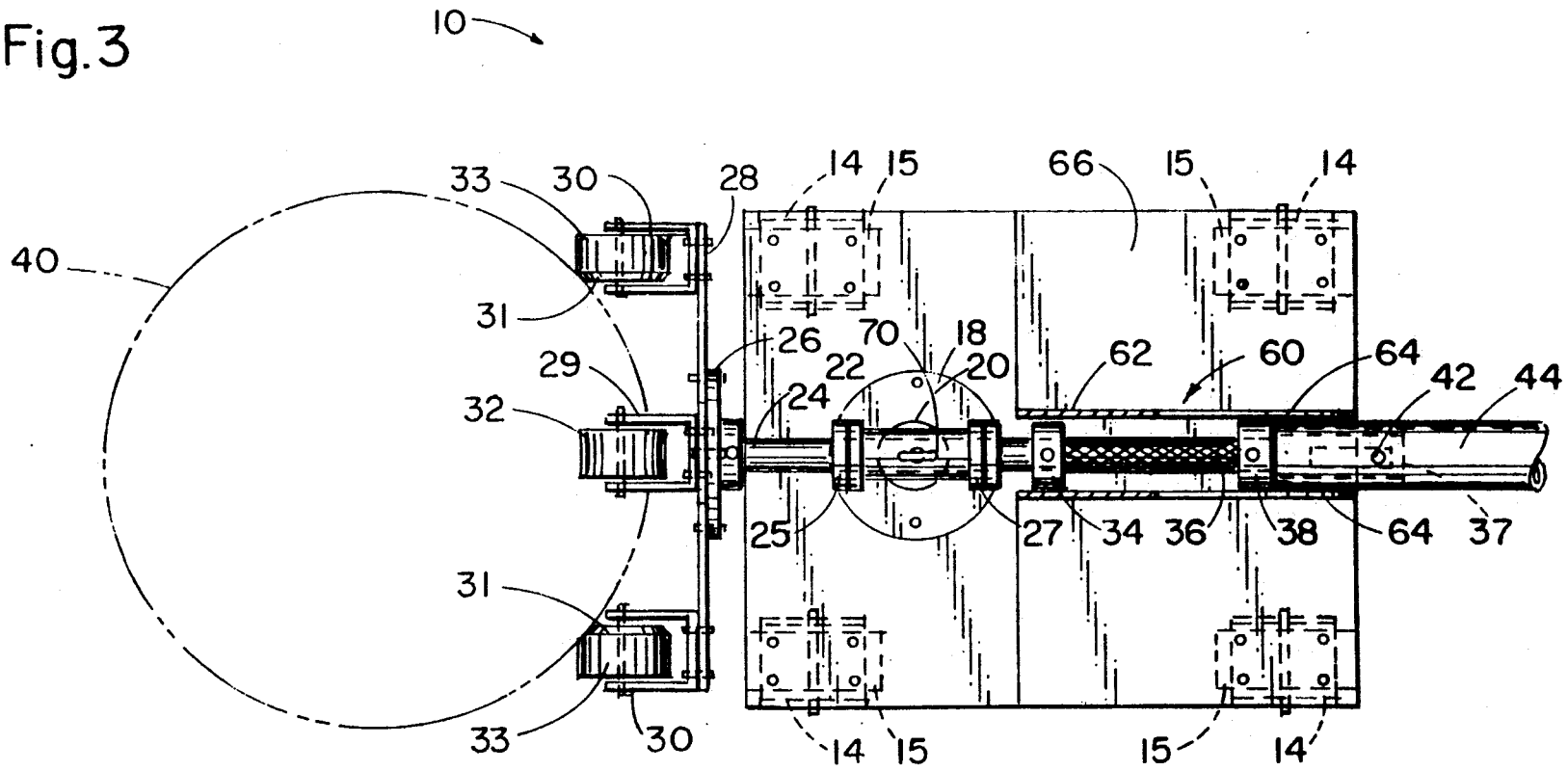

Referring now specifically to FIGS. 1, 2, 3 and 4 the numeral 10, with arrow refers to the overall invention. The numeral 12 refers to a platform dolly with a plurality of rigid casters 14, in this preferred embodiment, four such casters, forming a quadrangle aligned for fore and aft motion of the dolly 12. The wheels 15 of the casters 14 are manufactured of soft rubber or polyeurethane or the like to diminish side to side slippage and misalignment of the dolly 12 in the shoved motion imparted thereto, as it rolls upon the approach floor 16. The casters 14, themselves, may be rivetted, bolted, welded or monolithically cast with the dolly 12 in actual production.

Centrally located within the width of the platform 12, but toward the forward portion of the dolly 12 is an upright pedestal 20 with a flanged base 18. At the upper terminus of the pedestal 20 is a horizontally disposed journal 22, rigidly aligned in the fore and aft mode of the dolly 12. Coaxially and pivotally mounted within the journal 22 is a shaft 24 with a rigidly affixed flange 26 with its rigidly affixed faceplate 28 at the forward end of the invention. Upon the forward face of the faceplate 28 are four rigidly mounted casters 29 and 30. It should be noted that the upper and lower casters 29 are aligned vertically to roll with the bowling ball 40, and are ground to a slightly concave rolling surface to conform to the surface of the spherical ball. Casters 30, located at each side of the ball, 40, are also vertically disposed, at the exact centerline of the center of the ball and located at 90 degrees to the casters 29. The casters 30 are slightly beveled at their inner surfaces 31 to make a substantially frictional contact with the ball 40. All four caster wheels 32 and 33 are fabricated of soft rubber or polyeurethane to enhance the frictional contact with the ball 40. While the casters themselves rotate freely, the frictional contact is provided to impart a twising motion at the end of the propelling shove for the curve or hook desired by some bowlers.

Referring now to the shaft 24, there are fixed annular collars 25 and 27, fore and aft of the journal 22 to preclude fore and aft motion of the shaft 24 within the journal 22. The shaft 24 continues rearwardly from the collar 27 where it is rigidly coupled at 34 to a flexible shaft 36 which provides a smoothly turning, constant velocity rotational motion to the shaft 24. At the rear of the flexible shaft 36 is coupling 38 which is in turn rigidly affixed to a short length of rigid hollow tubing 37. To the rear of this tubing 37 is an internally mounted spring loaded detent 42 which is well known to those practiced in the art of telescopically extendable handles. Another telescopically combined set of handles 44 and 45 designated by the numeral 50, with arrow, are designed to fit over the stub shaft 37, detachabley coupled thereto. At the user end of the handle 50 is another telescopically fitted hand-grip 46 with its pliable handle grip 48.

Fitting over the flexible shaft 36 is an inverted U-shaped handle guide 60 (with arrow) with vertical sides 64 and the U-shaped bridge portion 62 and horizontal flanges 66. The purpose of the guide 60 is to limit the flexible shaft 36 to a vertically disposed arc so that the dolly 12 will not twist to the left or right as it is being shoved forward against the ball 40. Thus it can be seen, that for compactness and portability, the handle 50 can be telescopically compressed and detached from the dolly 12. The detachable hand-grip 46 may have a loop or lanyard (not shown) to slip around the user's wrist in the event that the handle slips from his or her hand. The purpose of a detachable hand grip will be explained in the description of FIGS. 8 and 9.

It should be noted that a thumb-screw 70, mounted at the top of the journal 22 may be used to immobilize the twistability of the faceplate 28. This would ensure a bowler of a straight motion being imparted to the ball 40 when so desired.

It should be also noted that the length of the shuffle-cue has nothing whatsoever to do with increasing or decreasing the motion provided in a normal arm-swing delivery of a bowling ball. All it does is to transfer forward motion to the ball without giving any viable advantage over a conventional delivery of the ball.

Figure 6:
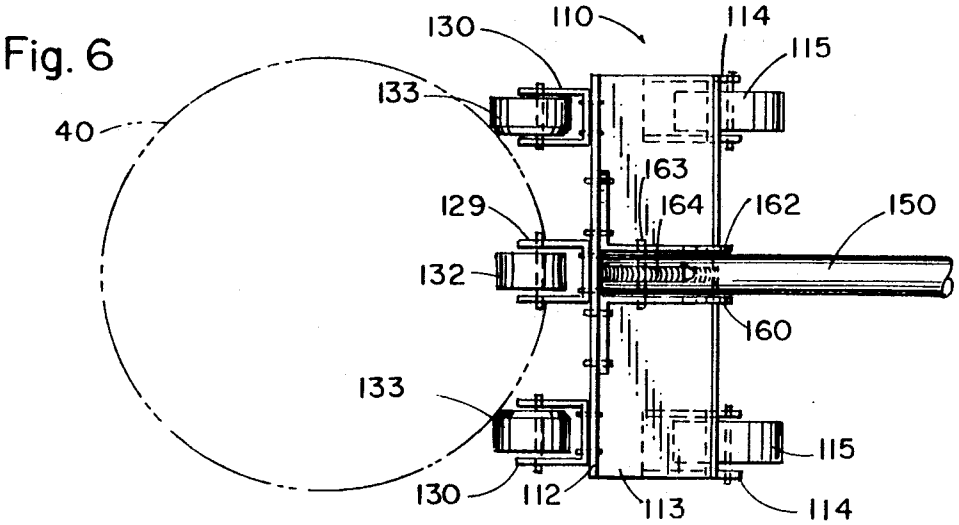
Figure 5:
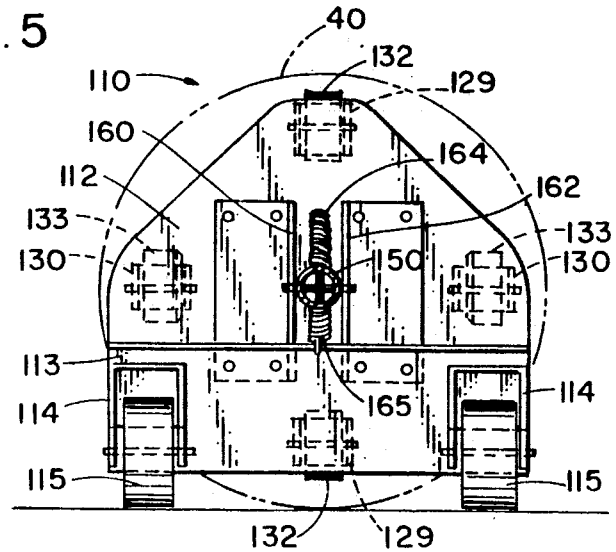
Figure 4:
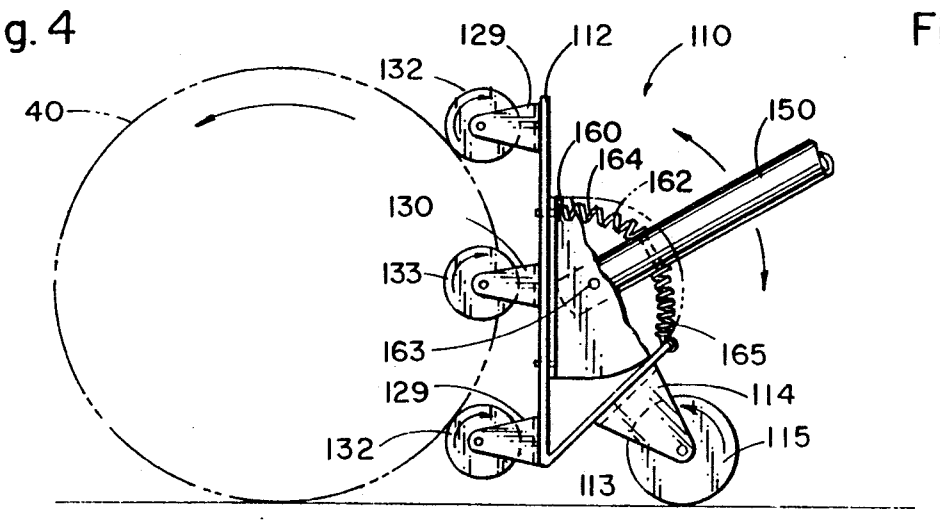
Figure 7:
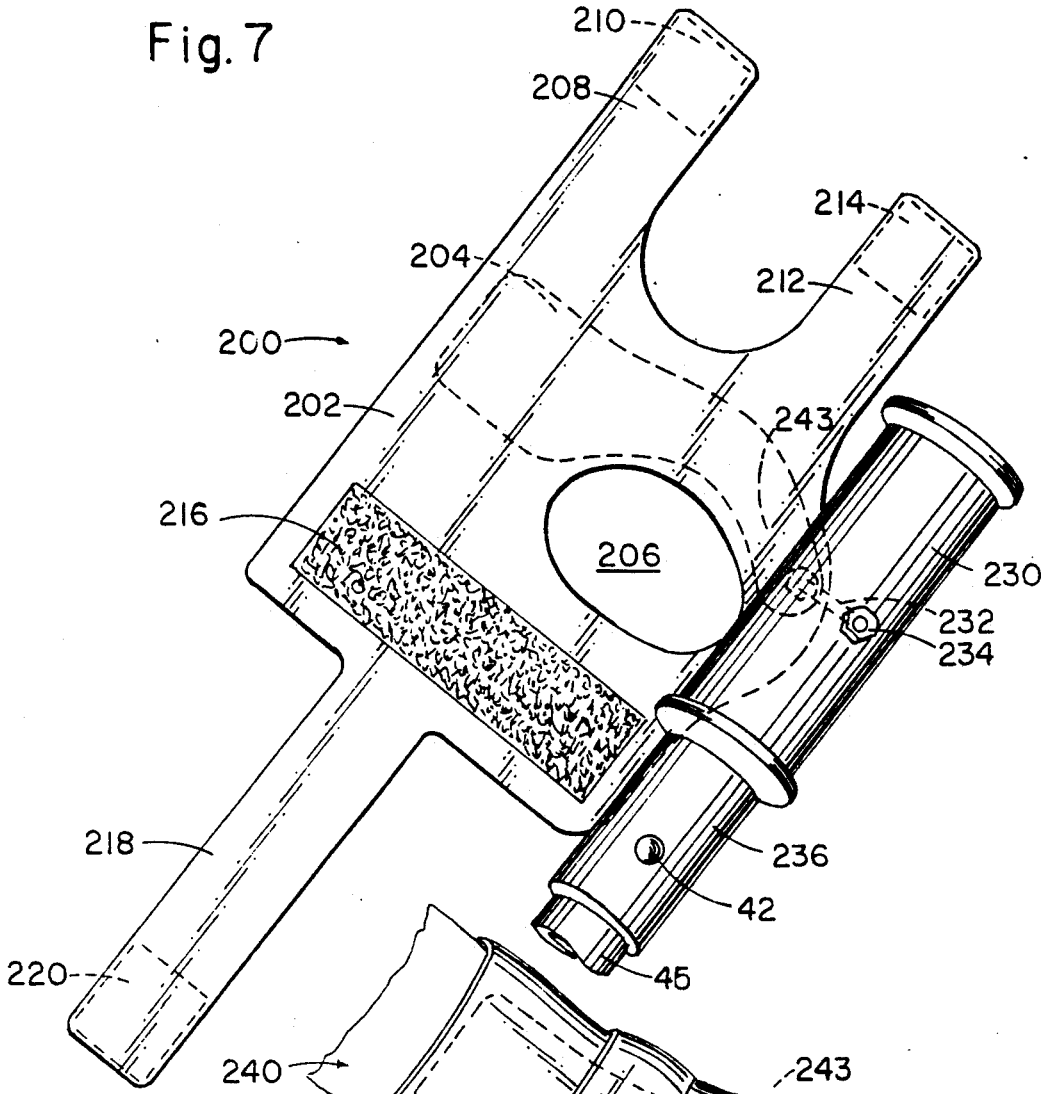

Referring now to FIGS. 5, 6 and 7 a simplified, less articulated shuffle cue is herein depicted, and is designed by the numeral 110 with arrow, and consists of a faceplate 112 positioned in a generally vertical mode. The faceplate has four casters 129 and 130 with wheels 132 and 133, respectively, corresponding to the configuration described in the previous version of the invention. However, in this version, the bottom of the faceplate 112 is braked at an acute angle of approximately 45 degrees as at 113, which forms a base-plate support for a pair of rigidly mounted casters 114 with their wheels 115, said casters being oriented to provide a fore and aft motion when propelled by the shuffle-cue 150. The shuffle cue 150 differs from the cue 50 of the primary version in that it is pivotally mounted between a pair of guides 160 and 162 by a horizontally disposed axle-pin 163. This arrangement allows only a vertically disposed arc by the shuffle cue 150. Counter-acting tension springs 164 and 165 keep the faceplate 112 in a generally vertical mode when the handle of the cue is held by the user. It maintains a generally vertical mode the entire time it is in contact with the bowling ball 40 while the user shoves the ball forward. This device restricts the bowler to "straight" bowling deliveries, for the most part, as it is difficult to impart a twist accurately since one or the other caster would rise off the floor and distort the action imparted by the shuffle cue. This device would be much simpler to manufacture, therefore cheaper to produce, but without a stability and accuracy provided by the previously described version.

Figure 8:
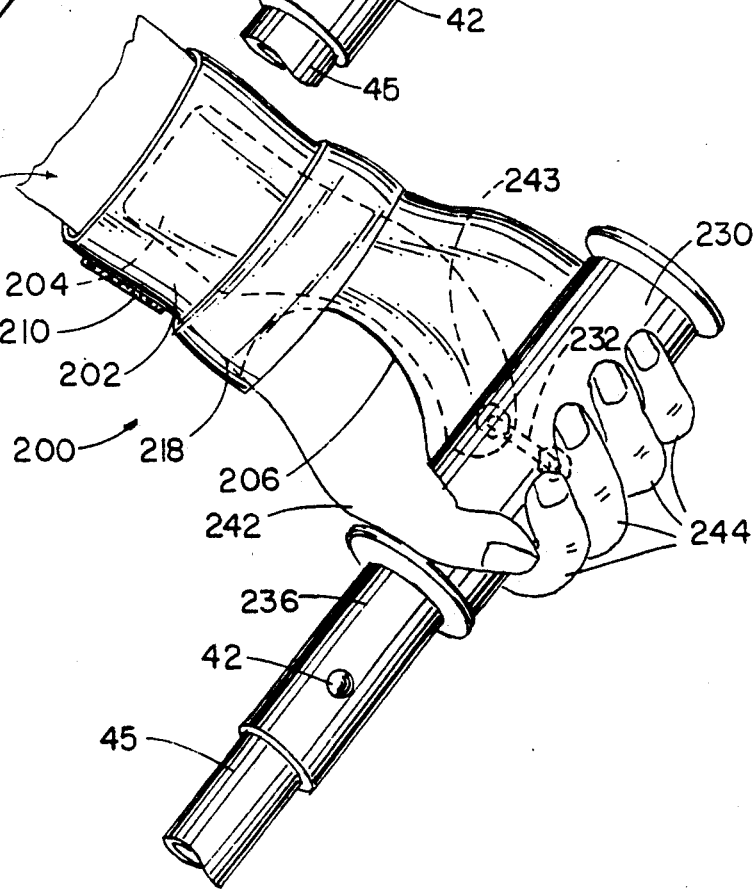

FIGS. 7 and 8 disclose but one possible detachable appliance that could be attached to the wrist or hand of a feeble or arthritic person. In both FIGS. 7 and 8, a device is shown which is known as the Automatic Positioner, marketed under the registered name "Robby's Automatic Positioner" and carries the U.S. Pat. No. 4,138,108. FIG. 7 discloses the Automatic Positioner when laid out flat, and modified to receive a pivotally installed hand-grip similar to that described in FIG. 1.

The Automatic Positioner is indicated by the numeral 200 with arrow, and consists of a palm pad 202 with a metal stiffening insert 204, shown in dotted lines, a thumb hole 206 and bifurcated tabs 208 and 212. On the undersides of tabs 208 and 212 are Velcro® hook pads 210 and 214, respectively. On the opposite side of the tabs 208 and 212 of the Positioner 200 is the receptor pad 216 for the hook pads 210 and 214 of the Velcro® fastener. A singular tab 218 with a hook pad 220 on the underside of the tab 218 emanates outwardly from the main body or palm pad 202 of the Positioner 200. At the bottom portion 243 of the metal stiffener 204, a bolt 232 is installed, pivotally passing through the pliable handle grip 230 and the tubular hand-grip 236. A nut, 234 secures the hand-grip and handlegrip to the Automatic Positioner 200. It is anticipated that a bushing and spacers could be installed over the bolt 232 and through the handle grip arrangement to ensure pivotability, said bushings and spacers not shown in these views. This device would fit over portion 45 of the handle 50 described in FIG. 1 and held in place by detent 42.

FIG. 9 shows the Positioner 200 fitted to the wrist 240 of a bowler, with his thumb 242 placed through the thumb-hole 206, and fingers 244 gripping the handle. Tabs 208, 212 and 218 are Velcro® fastened in place about the wrist 240. The Positioner 200 grips the wrist very firmly, allowing the user, if unable to curl his fingers about the handle, to let his fingers relax in an open position while still allowing control over the shuffle cue 50.

As previously stated, FIGS. 8 and 9 show but one possible adaption of a limb grasping applicance and is not intended to be all encompassing. It is anticipated that hundreds of different orthopedic devices can and will be custom fitted to a detachable handle appendage such as indicated by numeral 48 and 236. This should be acknowledgeable without departing from the scope or intent of this invention.

Thus it can be realized that any impaired person still having swingable use of an upper extremity will be able to use this invention to develop comparable skills of bowling to that of able-bodied bowlers. This can be a boon to form bowlers who have had to cease bowling due to decreased ability to grip bowling balls or to bend their knees during their approach and delivery of the ball. If the device is accepted by the American Bowling Congress as permitted bowling aid, arthritic former bowlers could resume sanctioned league bowling once again.

In carrying out the method of the present invention, a conventional bowling ball of any desired weight would need only one relatively small hole drilled in it for stabilizing the ball on the approach floor before manipulating the shuffle-cue. A constasting dot (white on a colored ball, black on a white ball) could be placed diametrically opposed to the hole for visually placing the ball on the drilled hole directly on the floor of the approach. The user places the ball at his desired location by the approach markers and lines up his shots according to the "spots" on the lane or the pins standing, as he prefers. He may then walk, if he is able, or stand, or sit, if unable to walk, shoving the shuffle cue when ready. In practice, it has been determined that if a hook or curve is desired, that the twisting motion be imparted at the very end of the arm during the delivery. To twist sooner will result in errativ motion of the ball, resulting in a gutter ball. Incidentally, nearly all lanes now have full length "bumpers" which can be lain in the gutters for bowling by small children. This eliminates "Gutter balls" entirely for small children, enhancing their enjoyment of the game with pins being knocked down with virtually every ball delivered.

The present disclosure includes that contained in the appended claims as well as that of the foregoing description. Although this invention has been described in its preferred forms with a certain degree of particularity, it is understood that the present disclosure of the preferred form has been made only by way of example and numerous changes in the details of construction and combination and arrangement of parts may be resorted to without departing from the spirit and scope of the invention.

Now that the invention has been described,

What is claimed is:

1. A method of assisting a physically impaired person when bowling comprising:

providing a dolly having roller means therebeneath positionable on a floor for effecting a linear direction of motion to the dolly and for moving a bowling ball in the linear direction;

providing a pedestal supported on the dolly, the pedestal having a shaft therein mounted in the direction of motion of the dolly, the shaft being mounted to allow a rotational motion about a horizontal axis, but to preclude linear motion of the shaft within the pedestal for imparting to a bowling ball a rotational motion essentially transverse to the linear direction, the axis being spaced from the floor a distance equal to the radius of the bowling ball;

providing a faceplate secured to the forward end of the shaft with rollers extending forwardly thereof for contacting a bowling ball on the floor to be rolled;

providing a handle flexibly coupled to the rearward end of the shaft for imparting a linear motion to the shaft, pedestal, dolly, roller means, faceplate, rollers and bowling ball;

providing a detachable constant velocity universally jointed coupling joining the handle and shaft;

providing vertical plates mounted on the dolly on opposite sides of the constant velocity universally jointed flexible coupling to allow for vertically restricted movement of the handle with respect to the shaft; and utilizing the handle to impart a motion to a bowling ball.

* * * * *